US010541499B2

(12) United States Patent
Tada

(10) Patent No.: US 10,541,499 B2
(45) Date of Patent: Jan. 21, 2020

(54) CONNECTOR

(71) Applicant: JAPAN AVIATION ELECTRONICS INDUSTRY, LIMITED, Shibuya-ku, Tokyo (JP)

(72) Inventor: Takashi Tada, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/097,435

(22) PCT Filed: Apr. 28, 2017

(86) PCT No.: PCT/JP2017/017046
§ 371 (c)(1),
(2) Date: Oct. 29, 2018

(87) PCT Pub. No.: WO2017/212830
PCT Pub. Date: Dec. 14, 2017

(65) Prior Publication Data

US 2019/0157811 A1 May 23, 2019

(30) Foreign Application Priority Data

Jun. 8, 2016 (JP) ..... 2016-114289

(51) Int. Cl.
*H01R 13/648* (2006.01)
*H01R 13/6585* (2011.01)
(Continued)

(52) U.S. Cl.
CPC ..... *H01R 13/6585* (2013.01); *H01R 13/504* (2013.01); *H01R 24/60* (2013.01); *H01R 13/521* (2013.01); *H01R 2107/00* (2013.01)

(58) Field of Classification Search
CPC .. H01R 24/60; H01R 13/6585; H01R 13/521; H01R 13/504; H01R 12/57
(Continued)

(56) References Cited

U.S. PATENT DOCUMENTS 10,170,867 B2 * 1/2019 Ju ..... H01R 13/6585
10,218,126 B2 * 2/2019 Kurosawa ..... H01R 24/60
(Continued)

FOREIGN PATENT DOCUMENTS

CN 204651582 U 9/2015
CN 204992018 U 1/2016
(Continued)

OTHER PUBLICATIONS

International Search Report (ISR) dated Aug. 1, 2017 issued in International Application No. PCT/JP2017/017046.
(Continued)

*Primary Examiner* — Jean F Duverne
(74) *Attorney, Agent, or Firm* — Holtz, Holtz & Volek PC

(57) ABSTRACT

A ground plate of a connector has protruding portions, a coupling portion and press-fit portions. The coupling portion couples rear ends of the protruding portions to one another. Each of the press-fit portions has a flat plate portion intersecting an up-down direction and press-fit protrusions protruding from the flat plate portion in a pitch direction. The press-fit portions are held by press-fitted portions provided to a base portion of a holding member, so that the ground plate is attached to the holding member. A regulating portion provided to the base portion of the holding member is located between the protruding portions in the pitch direction and located forward of the coupling portion in a front-rear direction and thereby regulating movement of the ground plate.

12 Claims, 12 Drawing Sheets

(51) Int. Cl.

| | |
|---|---|
| ***H01R 24/60*** | (2011.01) |
| ***H01R 13/504*** | (2006.01) |
| *H01R 13/52* | (2006.01) |
| *H01R 107/00* | (2006.01) |

(58) Field of Classification Search
USPC ..... 439/607.08
See application file for complete search history.

(56) References Cited

U.S. PATENT DOCUMENTS

| | | | | |
|---|---|---|---|---|
| 10,218,134 | B2 * | 2/2019 | Tsai | H01R 13/6585 |
| 2012/0196466 | A1 | 8/2012 | Igarashi et al. | |
| 2016/0064870 | A1 * | 3/2016 | Yu | H01R 24/60 439/607.05 |
| 2016/0322759 | A1 * | 11/2016 | Park | H01R 13/6585 |
| 2016/0365673 | A1 * | 12/2016 | Liang | H01R 12/57 |
| 2017/0207569 | A1 | 7/2017 | Arai et al. | |
| 2017/0222374 | A1 | 8/2017 | Saito et al. | |

FOREIGN PATENT DOCUMENTS

| | | | |
|---|---|---|---|
| JP | S61184285 | U | 11/1986 |
| JP | H10189148 | A | 7/1998 |
| JP | 2012169243 | A | 9/2012 |
| JP | 5813847 | B1 | 11/2015 |
| JP | 5905952 | B1 | 4/2016 |
| JP | 2016051577 | A | 4/2016 |
| TW | M518834 | U | 3/2016 |

OTHER PUBLICATIONS

Japanese Office Action dated Jul. 26, 2017 issued in counterpart Japanese Application No. 2016-114289.
Written Opinion dated Aug. 1, 2017 issued in International Application No. PCT/JP2017/017046.
Chinese Office Action dated Jul. 23, 2019 (and English translation thereof) issued in Chinese Application No. 201780025693.1.

* cited by examiner

CONNECTOR

TECHNICAL FIELD

This invention relates to a connector, in particular, to a connector having a mid-plate and a ground plate.

BACKGROUND ART

As shown in FIG. 23, a connector 900 described in Patent Document 1 has two contact rows 910 and 920, a holding member 930, a mid-plate 940, two ground plates 950 and a shell 960.

The contact rows 910 and 920 are arranged apart from each other in an up-down direction (a Z-direction) and held by the holding member 930. Each of the contact rows 910 and 920 has a plurality of contacts arranged in a pitch direction (an X-direction). The holding member 930 is integrally molded with the mid-plate 940. The mid-plate 940 is located between the contact rows 910 and 920 in the up-down direction. The mid-plate 940 and each of the contacts of the contact rows 910 and 920 are electrically isolated from each other by the holding member 930. The ground plates 950 are attached to the holding member 930 to sandwich the holding member 930 in the up-down direction. Each of the ground plates 950 and each of the contacts of the contact rows 910 and 920 are electrically isolated from each other by the holding member 930. The shell 960 surrounds the contact rows 910 and 920, the holding member 930, the mid-plate 940 and the ground plates 950.

PRIOR ART DOCUMENTS

Patent Document(s)

Patent Document 1: JPB5905952

SUMMARY OF INVENTION

Technical Problem

In the connector 900 described in Patent Document 1, firmer attaching of the ground plate 950 to the holding member 930 is desired.

It is an object of the present invention to provide a connector in which holding of a ground plate by a holding member is strengthened.

Solution to Problem

One aspect of the present invention provides, as a first connector, a connector which is mateable with a mating connector along a front-rear direction, wherein:

the connector comprises a plurality of contacts, a holding member, a mid-plate and a ground plate;

the holding member comprises a mating portion, a holding portion and a base portion;

the mating portion has a tongue-like shape and extends forward from the holding portion in the front-rear direction;

the holding portion is located between the mating portion and the base portion in the front-rear direction;

the base portion is provided with at least one regulating portion and at least one press-fitted portion;

the contacts are held by the holding portion of the holding member to form two contact rows;

the contacts included in each of the contact rows are arranged in a pitch direction perpendicular to the front-rear direction;

the contact rows are arranged apart from each other in an up-down direction perpendicular to both of the front-rear direction and the pitch direction;

the mid-plate is held by the holding member and located between the contact rows in the up-down direction;

the ground plate has a plurality of protruding portions, a coupling portion and a press-fit portion;

the coupling portion couples rear ends of the protruding portions to each other;

the press-fit portion has a flat plate portion intersecting with the up-down direction and press-fit protrusions protruding from the flat plate portion in the pitch direction;

the press-fit portion is held by the press-fitted portion, so that the ground plate is attached to the holding member; and the regulating portion is located between the protruding portions in the pitch direction and located forward of the coupling portion in the front-rear direction.

Advantageous Effects of Invention

In the connector 900 of Patent Document 1, the two ground plates 950 are attached to the holding member 930 to sandwich the holding member 930 from above and beneath in the up-down direction. Consequently, there is a possibility that the ground plates 950 are separated from the holding member 930.

On the other hand, the press-fit portion of the ground plate of the present invention has the flat plate portion intersecting with the up-down direction and the press-fit protrusions protruding from the flat plate portion in the pitch direction. When the ground plate is attached to the holding member, the press-fit portion is directed forward in the front-rear direction and press-fit into the press-fitted portion. At this time, the regulating portion of the holding member is located between the protruding portions of the ground plate in the pitch direction and located forward of the coupling portion of the ground plate in the front-rear direction. Accordingly, the ground plate is resistant to a force of the pitch direction and a force of a forward direction. Thus, the ground plate is firmly held by the holding member.

An appreciation of the objectives of the present invention and a more complete understanding of its structure may be had by studying the following description of the preferred embodiment and by referring to the accompanying drawings.

DESCRIPTION OF EMBODIMENTS

Figure 1:
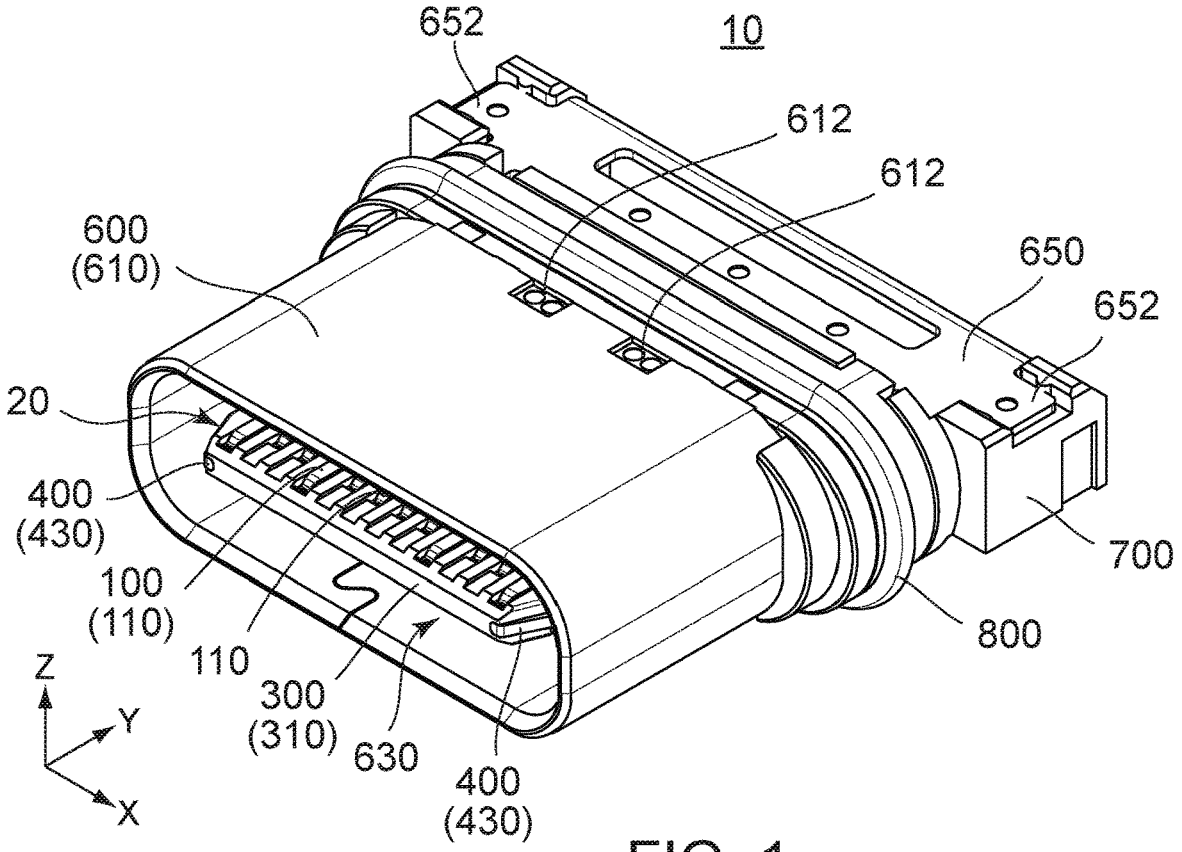
FIG. 1 is a top perspective view showing a connector according to an embodiment of the present invention.

While the invention is susceptible of various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
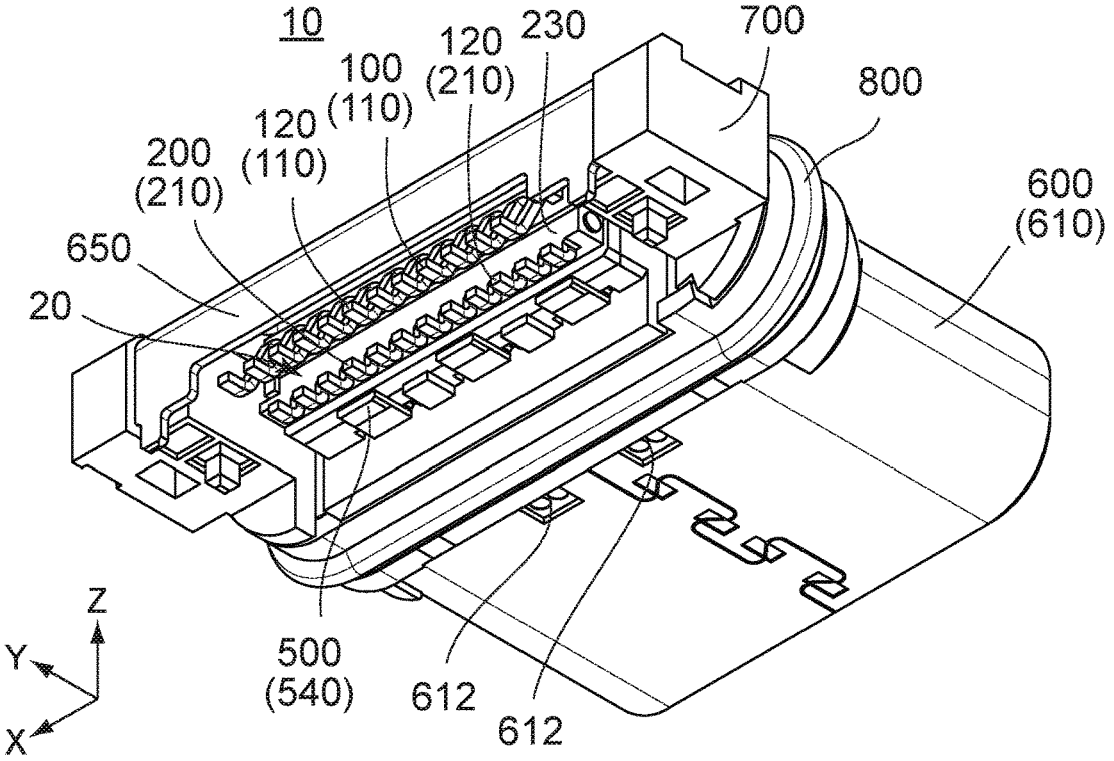
FIG. 2 is a bottom perspective view showing the connector of FIG. 1.

Referring to FIGS. 1 and 2, a connector 10 according to an embodiment of the present invention is a receptacle connector which is mateable with a mating connector (not shown) along a front-rear direction. The connector 10 is used in a state that it is mounted on a circuit board (not shown) of an electronic device and accommodated in a casing of the electronic device at least in part. In the present embodiment, the front-rear direction is a Y-direction. A negative Y-direction is directed forward while a positive direction is directed rearward.

As shown in FIGS. 1 and 2, the connector 10 has a subassembly 20, a front shell (shell) 600, a rear shell 650, a rear insulator 700 and a gasket 800. As shown in FIGS. 3 to 8, the subassembly 20 has first and second contact rows 100 and 200, a holding member 300, a mid-plate 400 and a pair of ground plates 500.

Figure 9:
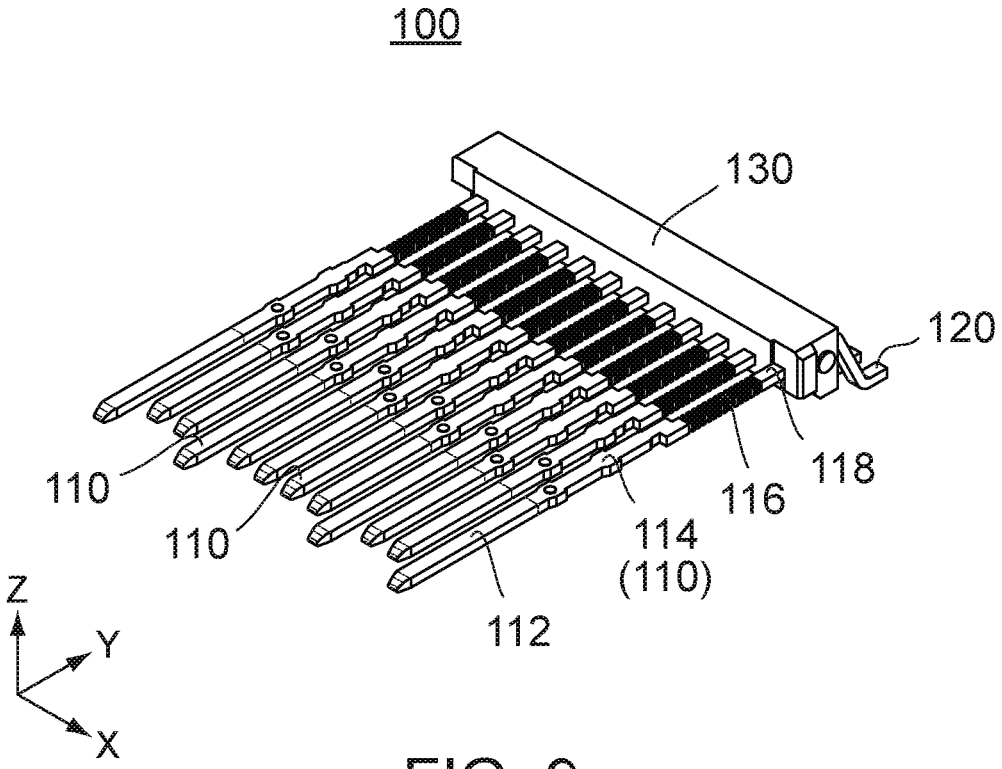
FIG. 9 is a top perspective view showing a first contact row included in the subassembly of FIG. 3.
Figure 10:
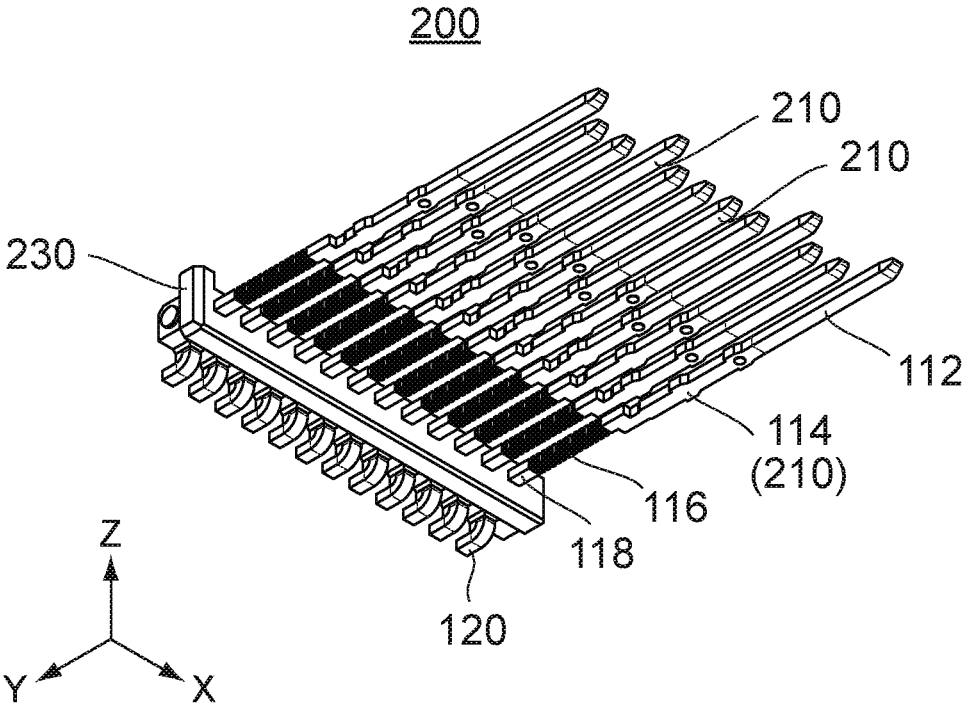
FIG. 10 is a bottom perspective view showing a second contact row included in the subassembly of FIG. 3.

As shown in FIGS. 9 and 10, the first and the second contact rows 100 and 200 have a plurality of contacts 110 and 210 and contact insulators 130 and 230, respectively. The contacts 110 and 210 are made of metal (conductor), and the contact insulators 130 and 230 are made of insulating resin. Each of the contacts 110 and 210 is formed by punching out a metal sheet, followed by bending the punched out metal sheet. Each of the contacts 110 and 210 has a shape extending in the front-rear direction and has a contact point portion 112, a press-fit portion 114, a water-stop portion 116, a fixed portion 118 and a connection portion 120 in this order from its front. The contacts 110 and 210 include power supply terminals which are relatively long in the front-rear direction and signal terminals which are relatively short in the front-rear direction. In the first contact row 100, the contacts 110 are arranged at intervals in a pitch direction perpendicular to the front-rear direction and fixed to one another by the contact insulator 130. In detail, the contact insulator 130 fixes the fixed portions 118 of the contacts 110 to one another by insert molding. Similarly, in the second contact row 200, the contacts 210 are arranged at intervals in the pitch direction perpendicular to the front-rear direction and fixed to one another by the contact insulator 230. In detail, the contact insulator 230 fixes the fixed portions 118 of the contacts 210 to one another by insert molding. In the present embodiment, the pitch direction is an X-direction perpendicular to the front-rear direction.

Figure 11:
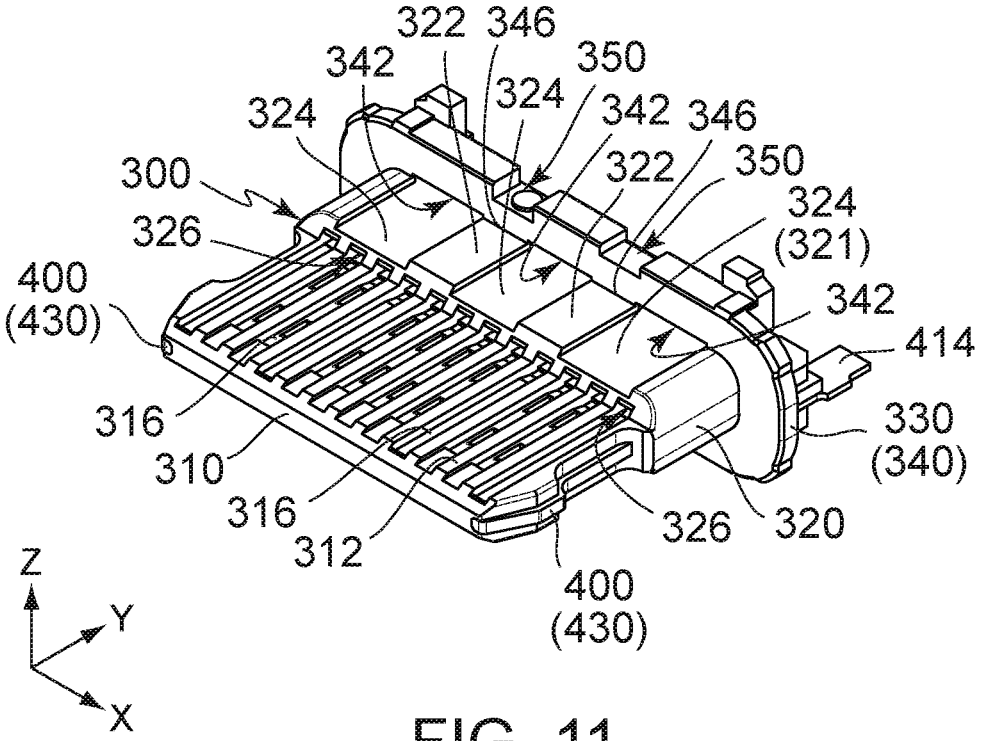
FIG. 11 is a top perspective view showing an assembly of a holding member and a mid-plate which are included in the subassembly of FIG. 3.
Figure 12:
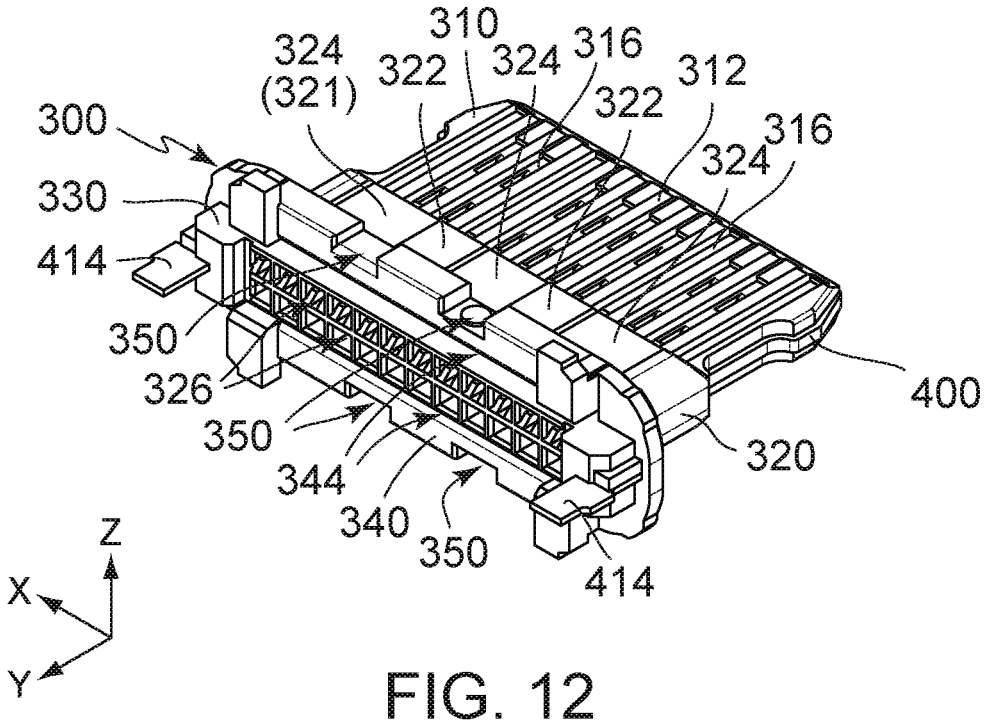
FIG. 12 is another top perspective view showing the assembly, of FIG. 11, of the holding member and the mid-plate.

As understood from FIGS. 11 and 12, the mid-plate 400 is held by the holding member 300. Concretely, the mid-plate 400 is embedded in the holding member 300 in part by insert molding. The holding member 300 is made of insulating resin, and the mid-plate 400 is made of metal (conductor). As understood from FIGS. 7 and 8, the mid-plate 400 is located in the middle of the holding member 300 in an up-down direction. In the present embodiment, the up-down direction is a Z-direction perpendicular to both of the front-rear direction and the pitch direction. As understood from FIGS. 11, 12 and 14, in contact accommodation portions 316 for the power supply terminals, holes (or hollows) reaching the mid-plate 400 do not exist in order to prevent a short circuit between each of the contacts 110 and 210 and the mid-plate 400 from being caused by entering of water.

Figure 15:
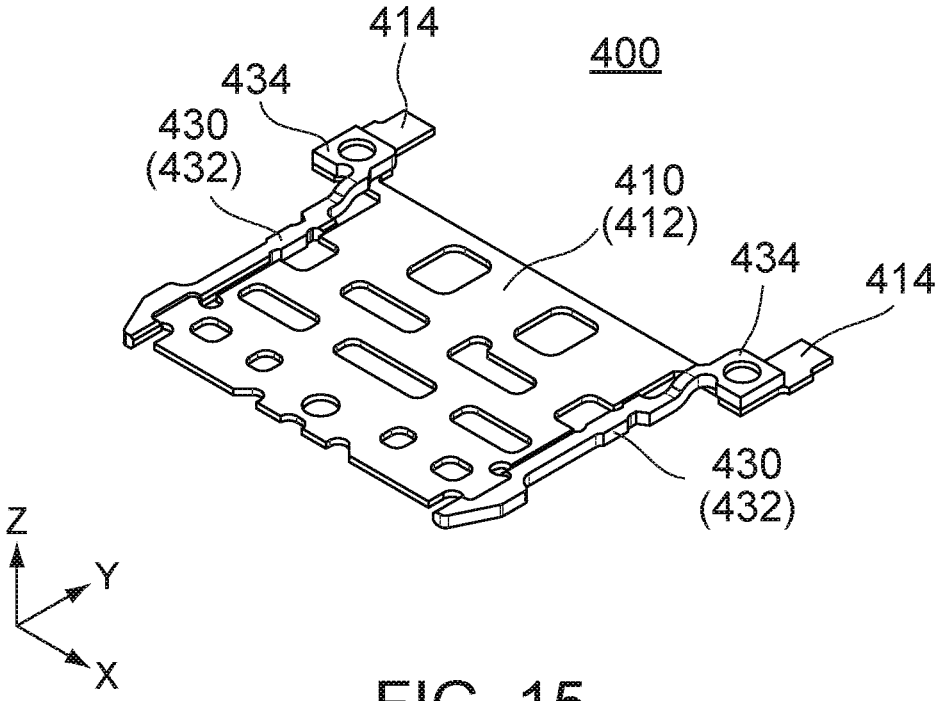
FIG. 15 is a top perspective view showing the mid-plate included in the assembly, of FIG. 11, of the holding member and the mid-plate.

As shown in FIG. 15, the mid-plate 400 has a main plate 410 and a pair of locking members 430. The main plate 410 has a main portion 412 with an approximately rectangular shape and connection portions 414 which protrude outward from the main portion 412 in the pitch direction and further protrude rearward. Each of the locking members 430 has an arm portion 432 extending in the front-rear direction and a fixed portion 434 protruding outward from a rear end of the arm portion 432 in the pitch direction. The main plate 410 is formed by punching out a metal sheet. Each of the locking members 430 is formed by punching out another metal sheet and bending a punched out metal sheet. The main plate 410 is formed by using a metal sheet with a relatively small size in thickness to reduce height and weight thereof, and each of the locking members 430 is formed by using a metal sheet with a relatively large size in thickness to ensure strength. The locking members 430 are fixed to the main plate 410 to be along side portions of the main plate 410 in the pitch direction.

Referring to FIGS. 11 and 12, the holding member 300 is provided with a mating portion 310, a holding portion 320 and a base portion 330. The mating portion 310 has a tongue-like shape and extends forward from the holding portion 320 in the front-rear direction. The holding portion 320 is located between the mating portion 310 and the base portion 330 in the front-rear direction. As understood from FIG. 13, when viewed along the front-rear direction, an outer shape of the holding portion 320 is larger than an outer shape of the mating portion 310. As understood from FIGS. 11 to 14, the base portion 330 is located rearward of the holding portion 320 in the front-rear direction and has a flange portion (a wall portion) 340 protruding outward in a plane perpendicular to the front-rear direction. However, the present invention is not limited thereto. The base portion 330 may have at least one wall, which protrudes outward in the up-down direction and extends in the pitch direction, instead of the flange portion 340.

Figure 13:
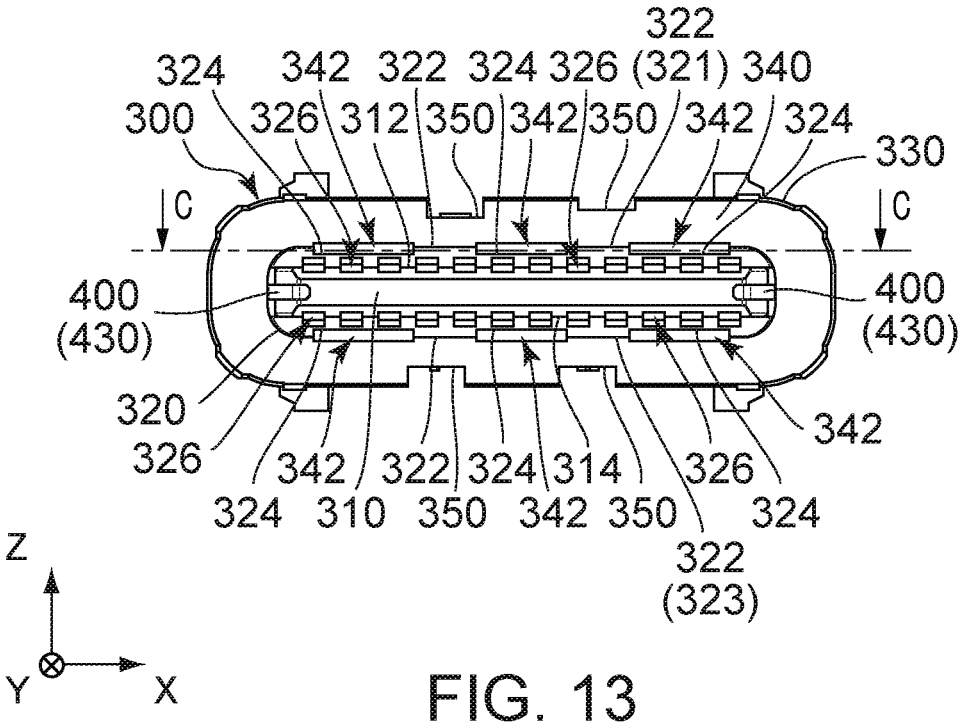
FIG. 13 is a front view showing the assembly, of FIG. 11, of the holding member and the mid-plate.

As understood from FIGS. 11 to 13, the holding member 300 is provided with a plurality of contact holding holes 326 penetrating the holding portion 320 and the base portion 330 in the front-rear direction in order to hold the contacts 110 and 210. The contact holding holes 326 are disposed in upper and lower rows and arranged in the pitch direction. When viewed along the front-rear direction, an inner size of each of the contact holding holes 326 in the holding portion 320 is larger than an outer size of the contact point portion 112 of each of the contacts 110 and 210, but it is slightly smaller than an outer size of the press-fit portion 114, which includes press-fit protrusions, of each of the contacts 110 and 210. Moreover, when viewed along the front-rear direction, the inner size of the contact holding hole 326 in the base portion 330 is larger than the inner size of the contact holding hole 326 in the holding portion 320.

As understood from FIGS. 11 to 14, an upper surface 312 and a lower surface 314 of the mating portion 310 are formed with the contact accommodation portions 316 to receive the contacts 110 and 210, respectively, in part. The contact accommodation portions 316 are grooves 350 recessed in the up-down direction and continue to the contact holding holes 326, respectively.

As understood from FIGS. 11 to 13, each of an upper surface 321 and a lower surface 323 of the holding portion 320 is formed with three shallow groove portions 324 arranged in the pitch direction. However, the present invention is not limited thereto. The number of the shallow groove portions 324 depends on the number of protruding portions 510 of the ground plate 500, which are mentioned later. Each space between the shallow groove portions 324 adjacent to each other is formed with one reinforcing protrusion portion 322. In other words, one of the shallow groove portions 324 is located on each space between two of the reinforcing protrusion portions 322 in the pitch direction, while another one of shallow groove portions 324 is located on each space outside of the reinforcing protrusion portions 322 in the pitch direction. Each of the shallow groove portions 324 extends in the front-rear direction, and it is recessed inward in the up-down direction. The reinforcing protrusion portions 322 extend in the front-rear direction and protrude outward of the shallow groove portions 324 in the up-down direction. Inner walls of the shallow groove portions 324 form sidewalls of the reinforcing protrusion portions 322.

Figure 14:
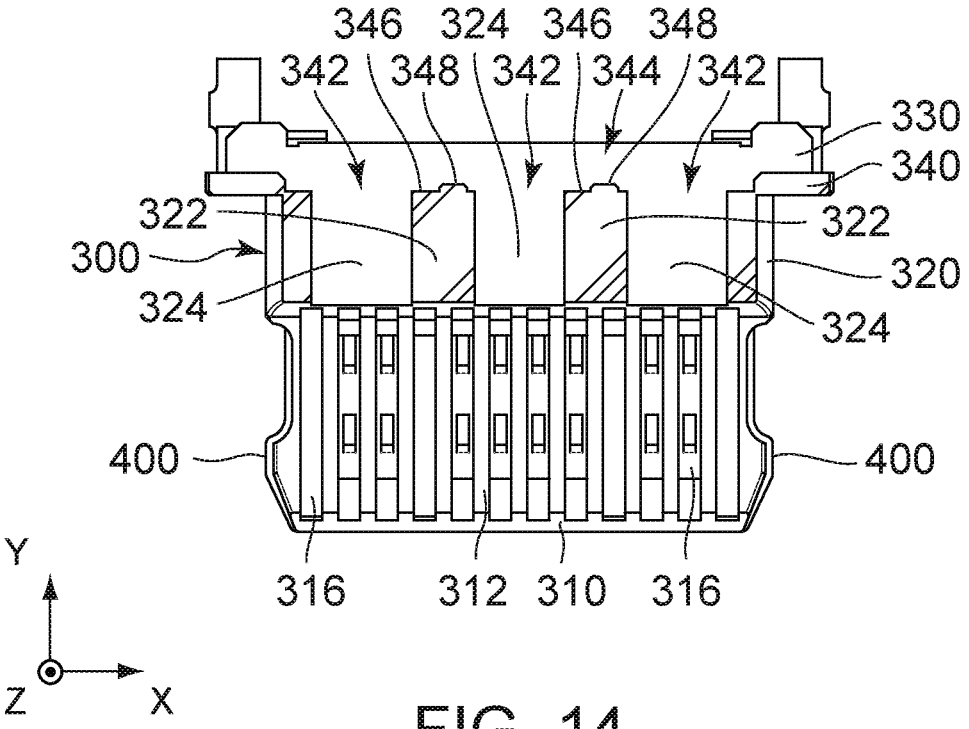
FIG. 14 is a cross-sectional view showing the assembly, of FIG. 13, of the holding member and the mid-plate, taken along line C-C.

As understood from FIGS. 11 to 14, the base portion 330 of the holding member 300 is provided with six through holes 342 penetrating the flange portion 340 in the front-rear direction. These through holes 342 continue to the shallow groove portions 324 formed in the holding portion 320, respectively. That is, in the present embodiment, the through holes 342 are provided in an upper part of the holding member 300 by three and in a lower part thereof by three. However, the present invention is not limited thereto. The number of the through holes 342 also depends on the number of the protruding portions 510 of the ground plate 500, which are mentioned later. The through holes 342 formed in each of the upper and the lower parts of the holding member 300 are arranged apart from one another in the pitch direction. In detail, as shown in FIGS. 11 and 14, the through holes 342 adjacent to each other in the pitch direction are separated from each other by a partition wall (or a regulating portion) 346. In other words, the base portion 330 is provided with two partition walls 346 in each of the upper and the lower parts of the holding member 300, and each of the partition walls 346 is located between the through holes 342 in the pitch direction. The number of the partition walls 346 also depends on the number of the protruding portions 510 of the ground plate 500, which are mentioned later. The partition walls 346 continue from the reinforcing protrusion portions 322 of the holding portion 320, respectively. In other words, the reinforcing protrusion portions 322 extend forward from the partition walls 346, respectively. As understood from FIGS. 12 and 14, the three through holes 342 formed in each of the upper and the lower parts of the holding member 300 are coupled with one another at rear parts of them to form a slot 344.

As shown in FIGS. 11 to 13, each of end faces of the flange portion 340 in the up-down direction is provided with two grooves (press-fitted portions) 350 recessed inward in the up-down direction. However, the present invention is not limited thereto. The number of the groove(s) 350 may be at least one in relation to each of the ground plates 500. As understood from FIGS. 5 and 14, positions of the grooves 350 are identical with positions of the partition walls 346 in the pitch direction. In detail, at least the middle of the groove 350 is located above or below the partition wall 346 in the pitch direction. A size of the groove 350 in the pitch direction is slightly smaller than a size between tips of press-fit protrusions 534 of the ground plate 500, which are mentioned later.

Figure 16:
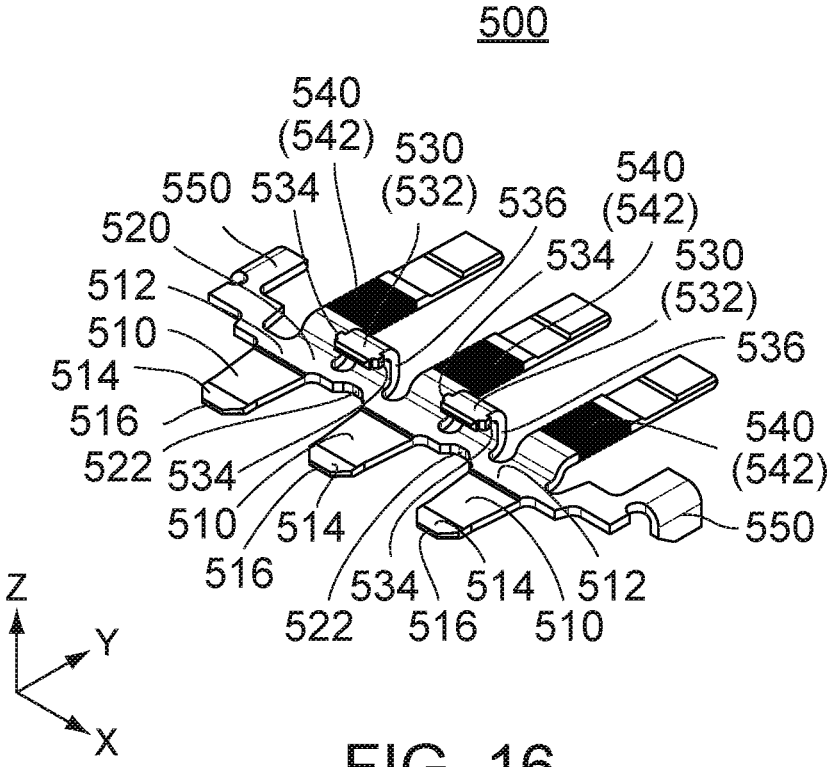
FIG. 16 is a top perspective view showing one of grand plates of a pair included in the subassembly of FIG. 3. The other of the ground plates is formed to be about the same as the ground plate illustrated.

As shown in FIG. 16, one of the ground plates 500 has the three protruding portions 510, a coupling portion 520, two press-fit portions 530, three extension portions 540 and two leg portions 550. The other of the ground plates 500 is approximately equal to the one of the ground plates 500, which is however turned upside down. In detail, two of the ground plates 500 have the same shape except that they are different from each other in length of the extension portions 540. Each of the ground plates 500 is formed by punching out a metal (conductor) sheet, followed by bending the punched out metal sheet. However, the present invention is not limited thereto. The number of the protruding portions 510 of the ground plate 500 may be at least two, and the number of each of the press-fit portion(s) 530 and the extension portion(s) 540 may be at least one. Moreover, the number of the ground plate(s) 500 may be one.

As shown in FIG. 16, the protruding portions 510 are coupled to one another by the coupling portion 520 to be arranged in the pitch direction. In detail, the coupling portion 520 extends in the pitch direction and couples rear ends 512 of the protruding portions 510 to one another. A size of thickness of a part of the protruding portion 510 is smaller than a size of thickness of the coupling portion 520. That is, each of the protruding portions 510 is thinner than the coupling portion 520 in part. However, the size of thickness of the whole of the protruding portion 510 may be smaller than the size of thickness of the coupling portion 520. The extension portions 540 are located rearward of the protruding portions 510, respectively, and extend rearward from the coupling portion 520. As understood from FIG. 5, in the pitch direction, a position of the middle of the extension portion 540 is not identical with a position of the middle of the protruding portion 510. However, the position of the middle of the extension portion 540 in the pitch direction and the position of the middle of the protruding portion 510 in the pitch direction may be identical with each other. As shown in FIG. 16, the extension portions 540 are provided with water-stop portions 542. Each of the water-stop portions 542 is provided with a plurality of grooves intersecting with the front-rear direction. In the present embodiment, the grooves of the water-stop portion 542 surround an entire periphery of the extension portion 540 in a plane perpendicular to the front-rear direction. The leg portions 550 extend outward from the coupling portion 520 in the pitch direction. Each of the press-fit portions 530 is located between adjacent two of the extension portions 540 in the pitch direction. It can also be said that each of the press-fit portions 530 is located between adjacent two of the protruding portions 510 in the pitch direction. The press-fit portion 530 has a flat plate portion 532, press-fit protrusions 534 and a connection portion 536. The flat plate portion 532 is a flat-shaped part intersecting with the up-down direction. In the present embodiment, the flat plate portion 532 has a rectangular shape long in the pitch direction. The press-fit protrusions 534 protrude outward from the flat plate portion 532 in the pitch direction. The connection portion 536 couples the flat plate portion 532 and the coupling portion 520 to each other. In detail, the connection portion 536 extends upward after slightly rearward extending from a rear edge of the coupling portion 520, and further extends frontward to continue to the flat plate portion 532. The flat plate portion 532 extends forward from the connection portion 536. Accordingly, the flat plate portion 532 is located above the coupling portion 520 and approximately parallel to the coupling portion 520.

Figure 4:
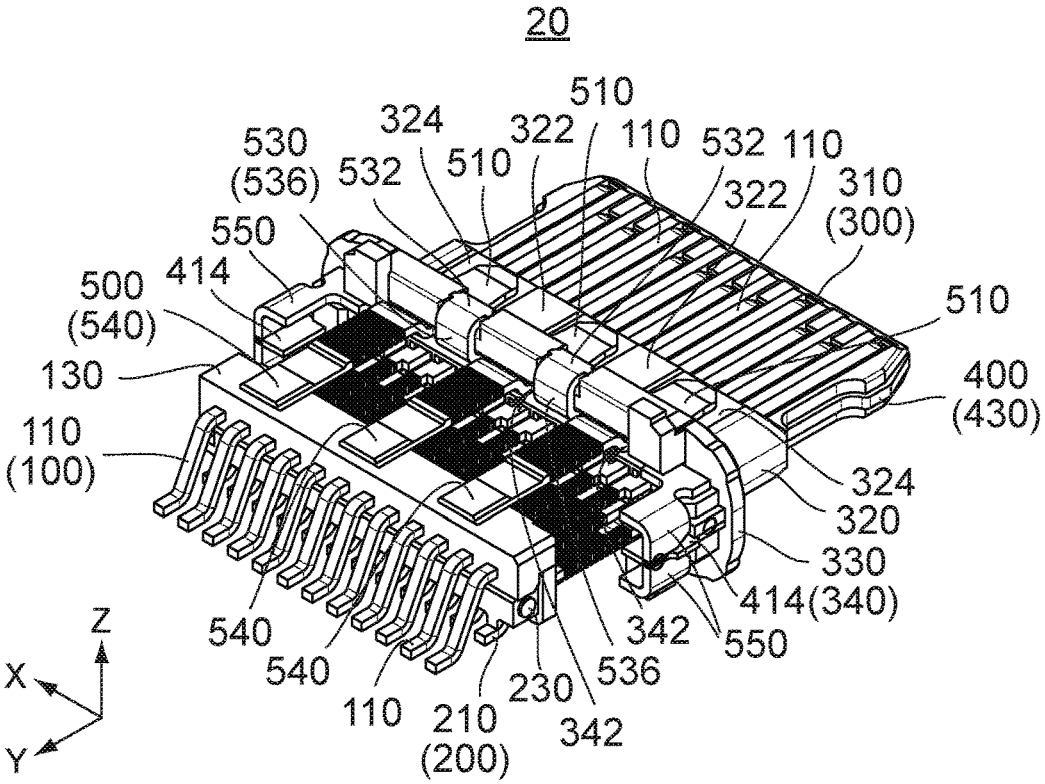
FIG. 4 is another top perspective view showing the subassembly of FIG. 3.
Figure 5:
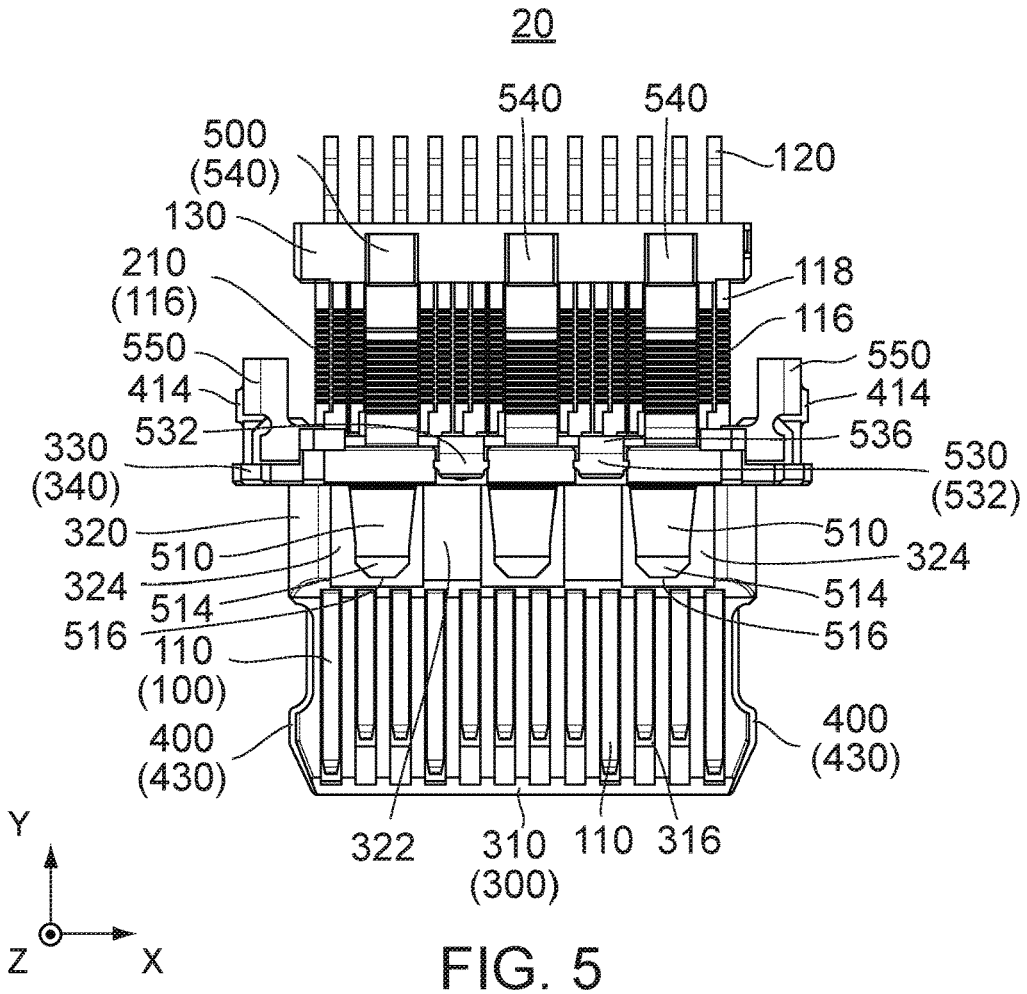
FIG. 5 is a plan view showing the subassembly of FIG. 3.
Figure 6:
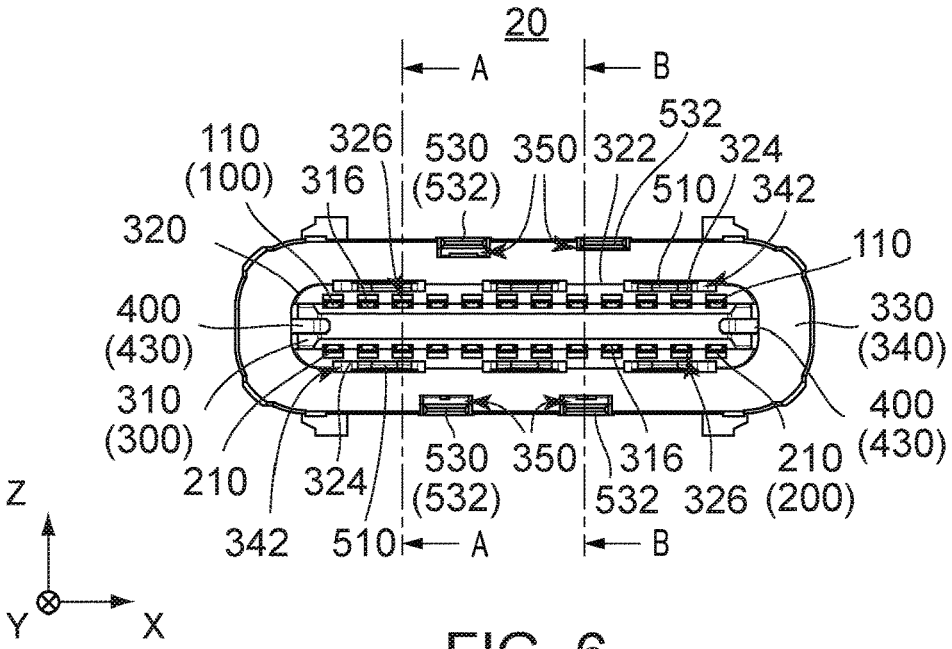
FIG. 6 is a front view showing the subassembly of FIG. 3.
Figure 7:
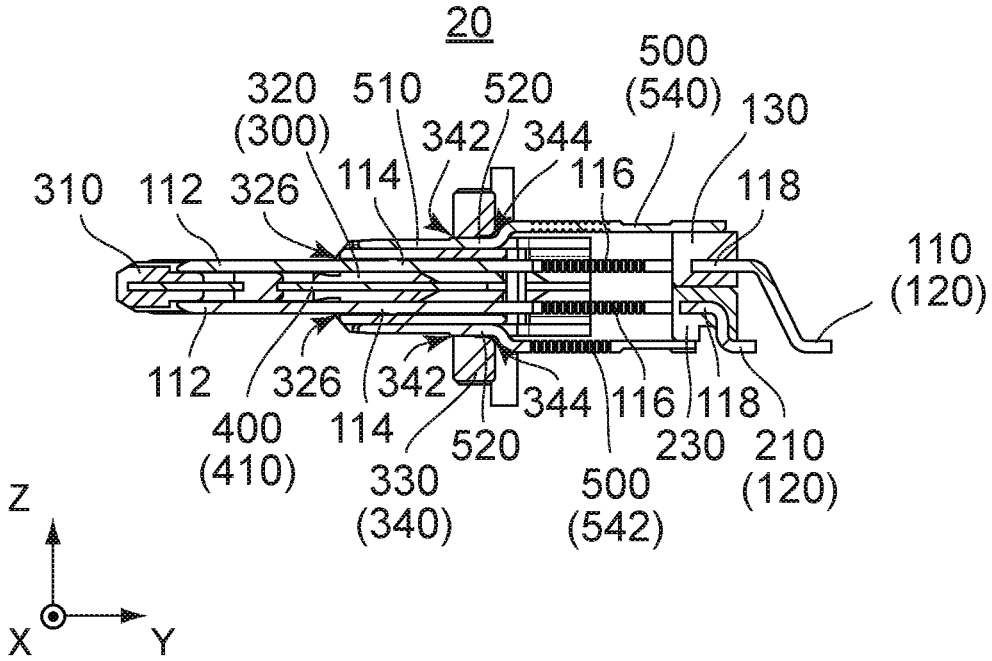
FIG. 7 is a cross-sectional view showing the subassembly of FIG. 6, taken along line A-A.

As understood from FIGS. 3 to 8, the first and second contact rows 100 and 200 mentioned above are attached to the holding member 300 from behind the holding member 300. In detail, the contacts 110 and 210 of the first and the second contact rows 100 and 200 are inserted (press-fit) into the contact holding holes 326, respectively, from the rear of the holding member 300 toward the front thereof. The contact point portion 112 of each of the contacts 110 and 210 passes through the contact holding hole 326 to protrude forward from the contact holding hole 326 and to be accommodated in the contact accommodation portion 316 in part. On the other hand, the press-fit portion 114 stays (is press-fit) in the contact holding hole 326 of the holding portion 320 and thereby each of the contacts 110 and 210 is held by the holding member 300. Then, as shown in FIGS. 3 to 5, 7 and 8, the water-stop portion 116 is positioned rearward of the base portion 330 of the holding member 300 and outside the contact holding hole 326. As apparent from FIGS. 6 to 8, the first contact row 100 and the second contact row 200 are arranged apart from each other in the up-down direction in a state that they are held by the holding member 300. The mid-plate 400 is located between the first contact row 100 and the second contact row 200 in the up-down direction. The mid-plate 400 and each of the contacts 110 and 210 is electrically isolated from each other by the holding member 300. In addition, as shown in FIG. 6, the contacts 110 or 210 of each of the contact rows 100 and 200 are arranged in the pitch direction. Thus, in the present embodiment, the contacts 110 and 210 are held by the holding member 300 to form two of the contact rows 100 and 200.

The pair of the ground plates 500 mentioned above is also attached to the holding member 300 from behind the holding member 300 as understood from FIGS. 3 to 8. In detail, the ground plates 500 are attached to the holding member 300 so that the protruding portions 510 pass through the through holes 342 of the base portion 330 to be received in the shallow groove portions 324 of the holding portion 320, respectively, and that the flat plate portions 532 and the press-fit protrusions 534 of the press-fit portions 530 are press-fit into the grooves 350. By press-fitting the flat plate portions 532 and the press-fit protrusions 534 of the press-fit portions 530 into the grooves 350, the ground plates 500 are held by the holding member 300. In a state that the ground plates 500 are held by the holding member 300, the greater part of each of the protruding portions 510 is located forward of the through hole 342, and the protruding portion 510 is located in the shallow groove portion 324 in part. In detail, when viewed along the up-down direction, the protruding portions 510 are located in the shallow groove portions 324 except for rear edge portions of them, and they slightly protrude outward from the shallow groove portions 324 beyond the reinforcing protrusion portions 322 in the up-down direction. Moreover, the coupling portions 520 are located in the slots 344. Additionally, each of the protruding portions 510 is arranged to be located between two of the power supply terminals in the pitch direction. As understood from FIGS. 5 and 14, in the pitch direction, the partition wall 346 provided to the base portion 330 of the holding member 300 are located between the protruding portions 510. With this, movement of the ground plate 500 in the pitch direction is regulated by the partition walls 346. The partition walls 346 are also located forward of the coupling portion 520 in the front-rear direction. With this, forward movement of the ground plate 500 is regulated by the partition walls 346. In order to regulate the movement of the ground plate 500 more in the pitch direction, as shown in FIG. 14, each of the partition walls 346 is formed with a protruding portion 348 protruding rearward. As shown in FIG. 16, the coupling portion 520 of the ground plate 500 is formed with recess portions 522 corresponding to the protruding portions 348 of the partition walls 346.

Figure 3:
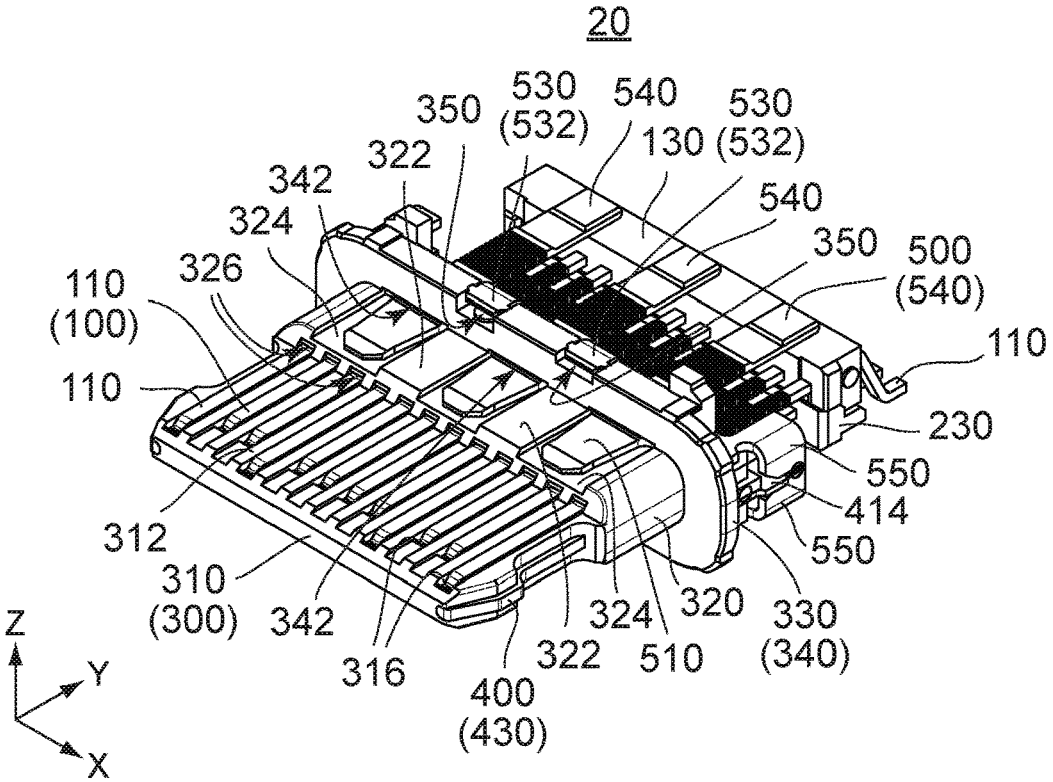
FIG. 3 is a top perspective view showing a subassembly included in the connector of FIG. 1.
Figure 8:
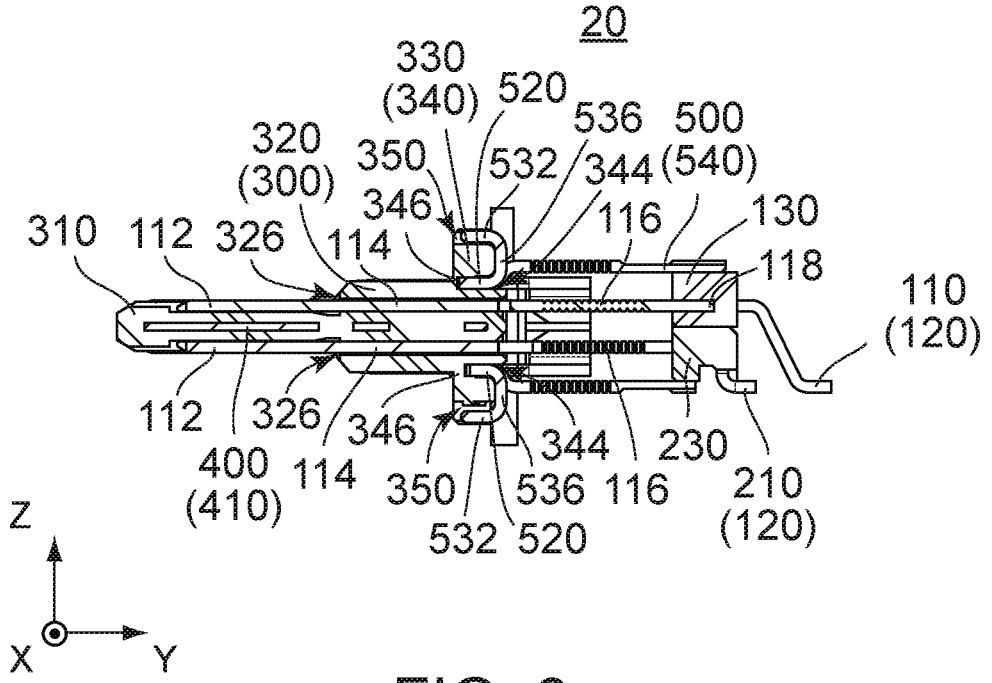
FIG. 8 is a cross-sectional view showing the subassembly of FIG. 6, taken along line B-B.

As understood from FIGS. 4 and 5, in the state that the ground plates 500 are held by the holding member 300, the connection portions 536 of the press-fit portions 530 are located rearward of the flange portion (the wall portion) 340 in the front-rear direction. As shown in FIG. 8, the flat plate portion 532, the connection portion 536 and the coupling portion 520 of the ground plate 500 are connected to one another in a U-shape when viewed from the pitch direction and surround a part of the flange portion (the wall portion) 340 in part. As understood from FIGS. 3 to 6, the flat plate portion 532 is located in the groove 350 and flush with the end face of the flange portion 340 in the up-down direction or protrudes outward of the end face of the flange portion 340 in the up-down direction. Furthermore, as shown in FIGS. 3 to 5, the leg portions 550 of the ground plates 500 are located near the connection portions 414 of the main plate 410 of the mid-plate 400. The leg portions 550 of the ground plates 500 and the connection portions 414 of the main plate 410 are connected to one another, so that the ground plates 500 and the mid-plate 400 are electrically connected to one another.

As understood from FIG. 5, among the three protruding portions 510 arranged in the pitch direction, each of two of the protruding portions 510 located outward in the pitch direction extends forward in the front-rear direction and extends slightly toward the middle of the connector 10 (the subassembly 20) in the pitch direction. Moreover, the middle position of a front edge 516 of each of these two protruding portions 510 in the pitch direction is nearer to the middle of the connector 10 (the subassembly 20) in the pitch direction than the middle position of the shallow groove portion 324 corresponding thereto in the pitch direction. In addition, each of the protruding portions 510 is tapered gradually forward. In particular, a front end portion 514 of each of the protruding portions 510 is tapered forward with a large taper angle larger than taper angles in the side of the rear end 512 (the coupling portion 520). This aims to enlarge an interval, as much as possible, between each of the ground plates 500 and each of the contacts 110 and 210 which are used as the power supply terminals (the contacts 110 and 210 which are relatively long in the front-rear direction).

Figure 17:
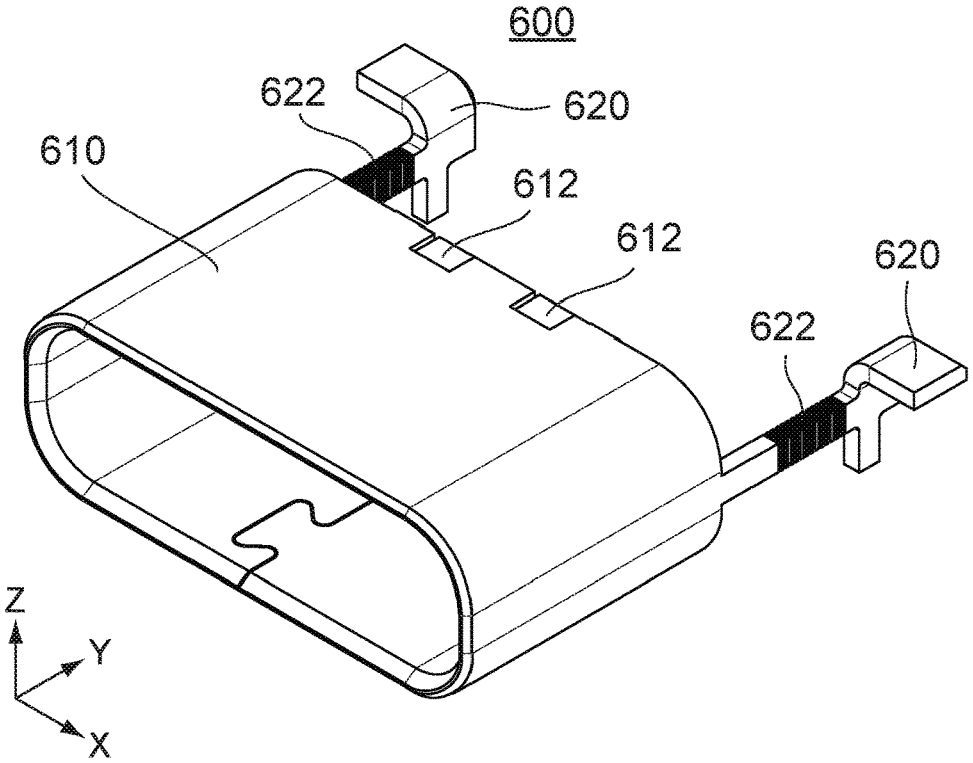
FIG. 17 is a top perspective view showing a front shell included in the connector of FIG. 1.
Figure 18:
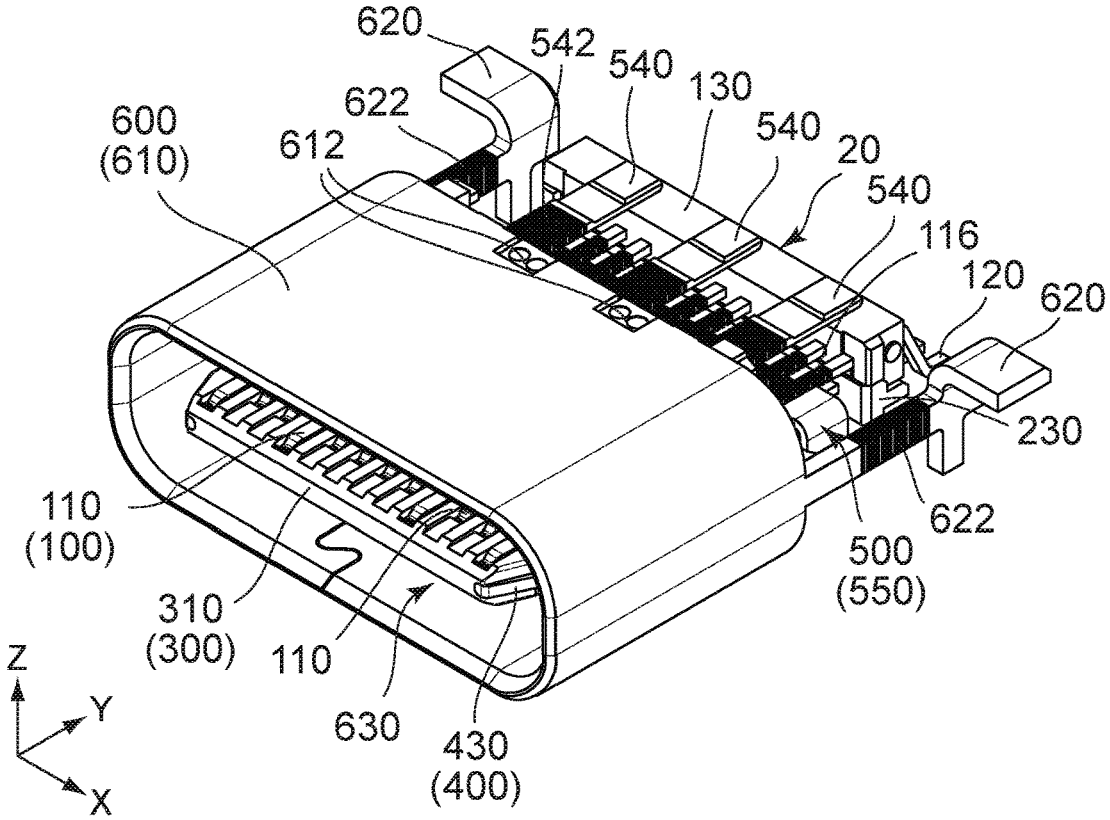
FIG. 18 is a top perspective view showing an assembly of the subassembly of FIG. 3 and the front shell of FIG. 17.

Referring to FIG. 17, the front shell 600 is made of metal (conductor) sheet and has a tubular portion 610 and a pair of leg portions 620. The tubular portion 610 has a roughly oval shape when viewed along the front-rear direction and defines an inner space passing therethrough in the front-rear direction. Moreover, a rear end portion of the tubular portion 610 is formed with welded portions 612. As shown in FIGS. 1 and 2, the welded portions 612 are formed on each of upper and lower sides of the tubular portion 610. Each of the welded portions 612 is processed to get thin in comparison with its vicinity to bring its thickness close to a thickness of the flat plate portion 532 of the ground plate 500 which is a welding mate. As shown in FIG. 17, the leg portions 620 are located at both sides of the tubular portion 610 in the pitch direction and extend rearward from a rear end of the tubular portion 610. Each of the leg portions 620 is provided with a water-stop portion 622. As understood from FIG. 18, the front shell 600 is attached to the subassembly 20. In detail, the subassembly 20 is press-fit into the front shell 600 from behind the front shell 600. Thus, the flange portion 340 almost fills a rear end side of the tubular portion 610. In addition, the flat plate portions 532 of the ground plates 500 are located in positions overlapping with the welded portions 612. After the subassembly 20 is press-fit into the front shell 600, the welded portions 612 are welded to the flat plate portions 532. As mentioned before, the flat plate portion 532 is flush with or protrudes from the end face of the flange portion 340. Accordingly, welding of the welded portions 612 and the flat plate portions 532 can be carried out easily and certainly. Thus, the flange portion 340 and a part of the subassembly 20 located forward of it are covered with the front shell 600. Then, between the tubular portion 610 and the subassembly 20, a connector accommodation portion 630 is formed to accommodate the mating connector (not shown). Although the shape of the flat plate portion 532 is flat for a purpose of welding to the shell 600, it may be slightly curved to the extent not detrimental to welding. In addition, in a case where the shell 600 is not attached, the shape of the flat plate portion 532 is not limited particularly.

Figure 19:
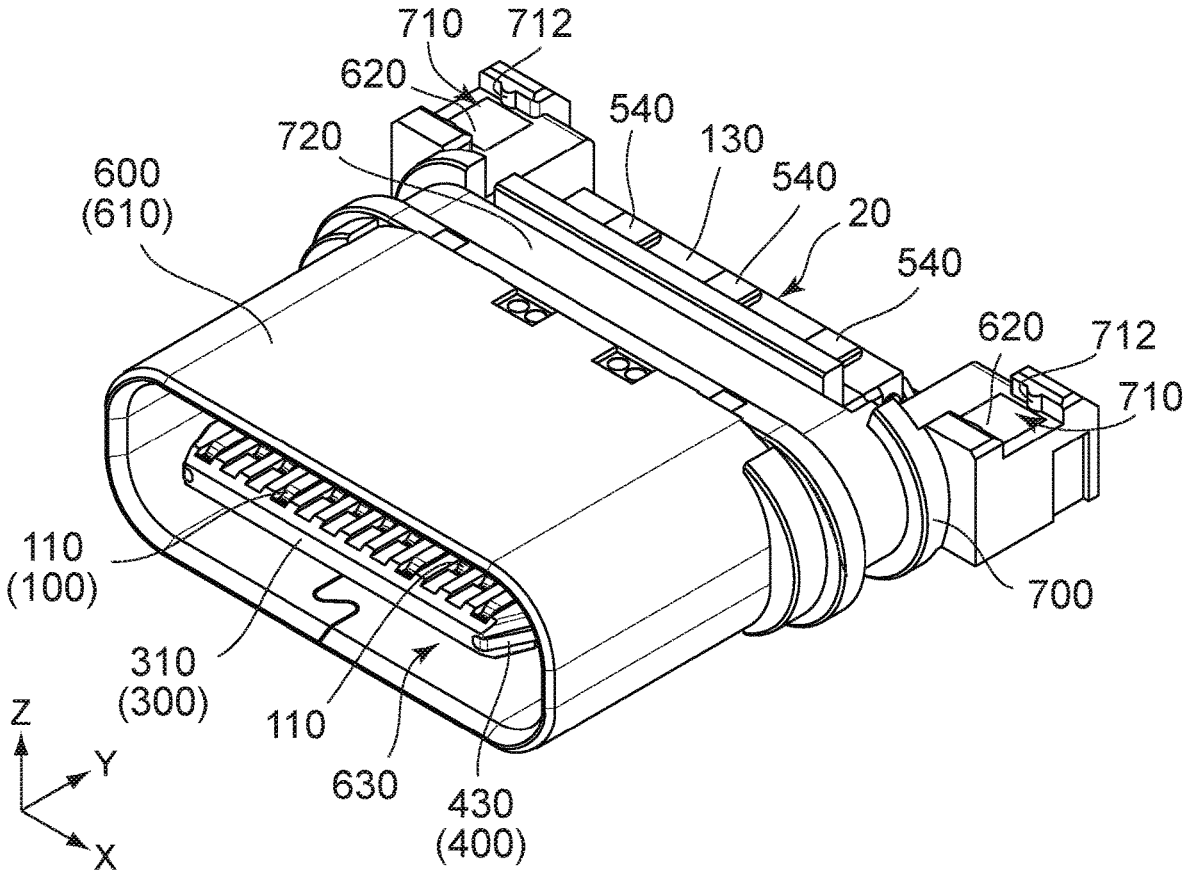
FIG. 19 is a top perspective view showing an assembly formed by integrally molding of a rear insulator to the assembly of FIG. 18.

As shown in FIG. 19, the rear insulator 700 is attached to an assembly of the subassembly 20 and the front shell 600. In detail, the rear insulator 700 is formed by insert-molding to the assembly of the subassembly 20 and the front shell 600 using an insulating resin. The rear insulator 700 fills a space between the base portion 330 of the holding member 300 and each of the contact insulators 130 and 230. The rear insulator 700 also covers the leg portions 620 of the front shell 600 to expose them in part. Thus, a periphery of each of the water-stop portions 116 of the contacts 110 and 210, the water-stop portions 542 of the ground plates 500 and the water-stop portions 622 of the front shell 600 is surrounded by the rear insulator 700. Here, the grooves forming the water-stop portions 116, 542 and 622 are embedded with the resin forming the rear insulator 700. With this, paths leading moisture into the electronic device (not shown) along the contacts 110 and 210, the ground plates 500 or the leg portions 620 of the front shell 600 are obstructed. As shown in FIG. 19, the rear insulator 700 is also formed with press-fitted portions 710 to which the rear shell 650 is attached and a groove 720 to which the gasket 800 is attached. Each of the press-fitted portions 710 is formed with press-fit protrusions 712. In each of the press-fitted portions 710, each of the leg portions 620 of the front shell 600 is exposed in part.

Figure 20:
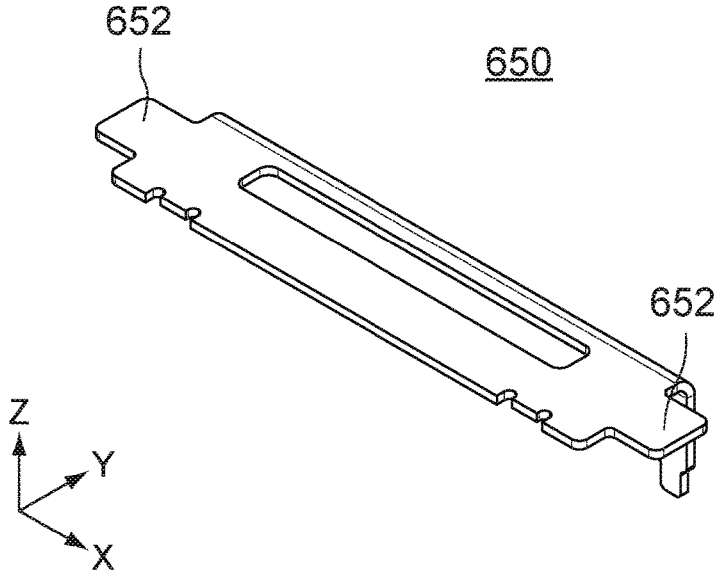
FIG. 20 is a top perspective view showing a rear shell included in the connector of FIG. 1.
Figure 21:
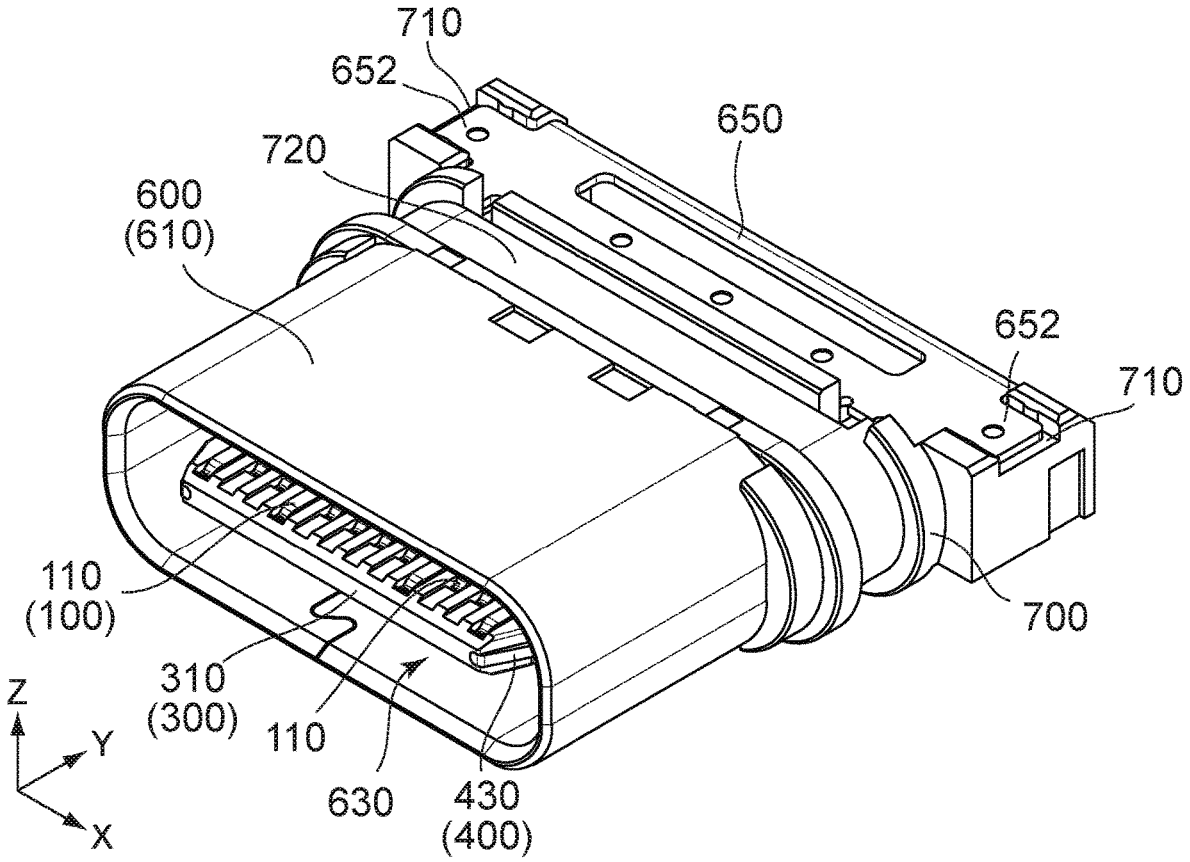
FIG. 21 is a top perspective view showing an assembly of the assembly of FIG. 19 and the rear shell of FIG. 20.

Referring to FIG. 20, the rear shell 650 is made of metal (conductor) sheet and has an L-shape when viewed along the pitch direction. The rear shell 650 has press-fit portions 652 at both end portions thereof in the pitch direction. As shown in FIG. 21, the press-fit portions 652 are press-fit into the press-fitted portions 710 of the rear insulator 700, so that the rear shell 650 is attached to the rear insulator 700. By connecting the press-fit portions 652 of the rear shell 650 to the leg portions 620 of the front shell 600 exposed in the press-fitted portions 710, the rear shell 650 is electrically connected to the front shell 600. As understood from FIG. 2, the rear shell 650 covers the connection portions 120 of the contacts 110 and 210 from above and behind in a state that it is attached to the rear insulator 700.

Figure 22:
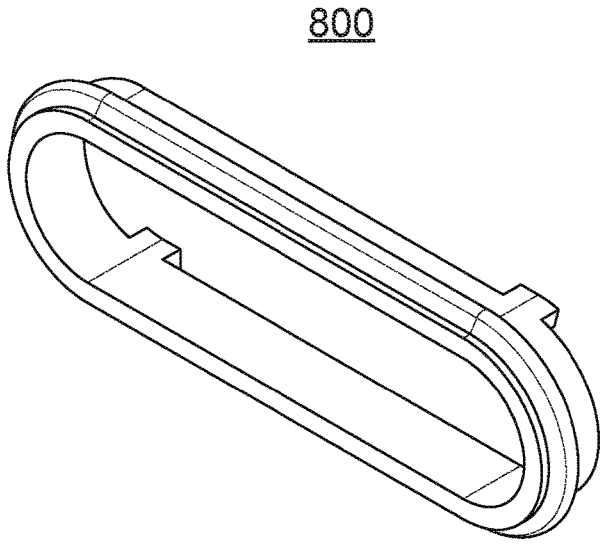
FIG. 22 is a top perspective view showing a gasket included in the connector of FIG. 1.
Figure 23:
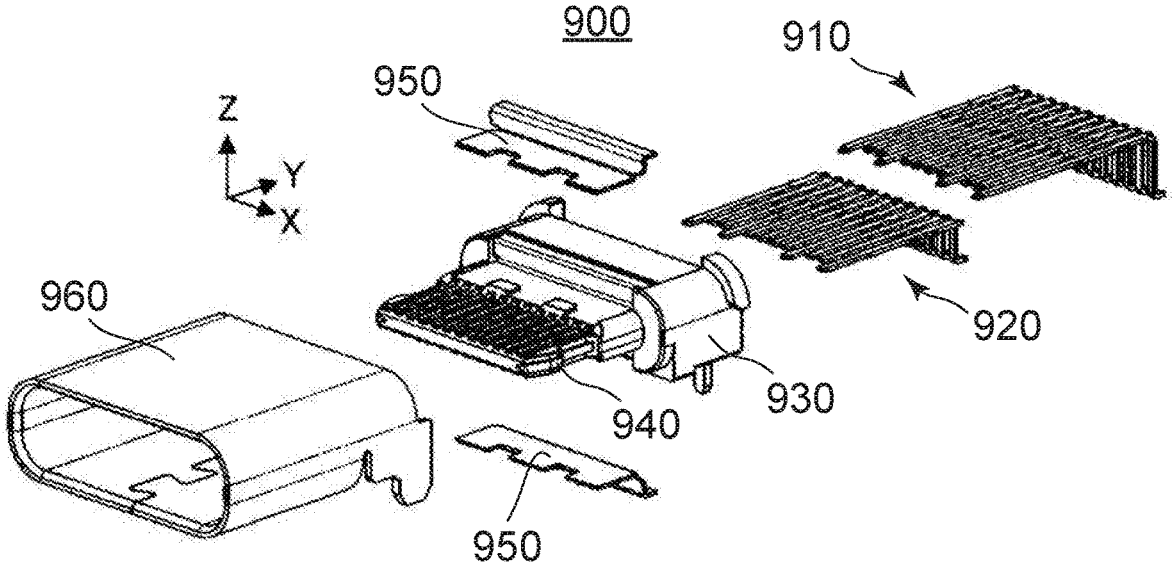
FIG. 23 PRIOR ART
FIG. 23 is an exploded perspective view of a connector disclosed in Patent Document 1.

As shown in FIG. 22, the gasket 800 has a flat ring shape corresponding to a shape of the groove 720 of the rear insulator 700. The gasket 800 is made of elastic material such as synthetic rubber and put in the groove 720 of the rear insulator 700 as shown in FIGS. 1 and 2. The gasket 800 surrounds a periphery of the rear insulator 700 in a plane perpendicular to the front-rear direction and achieves a waterproofing function between the connector 10 and the electronic device (not shown) to which the connector 10 is attached.

In the connector 10 structured as described above, each of the ground plates 500 has the plural protruding portions 510 and the coupling portion 520 connecting the rear ends 512 of them as mentioned above. Moreover, the holding member 300 has the partition wall (the regulating portion) 346 located between the protruding portions 510 of the ground plate 500 in the pitch direction and located forward of the coupling portion 520 in the front-rear direction. The partition wall 346 regulates the forward movement of the ground plate 500 and the movement thereof in the pitch direction. Thus, in the connector 10 according to the present embodiment, holding the ground plates 500 by the holding member 300 is strengthened even in the middle of connector assembling. In addition, by retaining rear ends of the connection portions 536 by the rear insulator 700, holding the ground plates 500 is further strengthened.

Furthermore, in the present embodiment, the protruding portions 510 protrude forward from the through holes 342 of the holding member 300, and they are located in the through holes 342 in part. Accordingly, movement of the protruding portions 510 in the up-down direction is also regulated by the holding member 300. Thus, in the connector 10 according to the present embodiment, holding the ground plates 500 by the holding member 300 is further strengthened.

In addition, according to the present embodiment, the flat plate portions 532, the connection portions 536 and the coupling portion 520 of the ground plate 500 surround the part of the flange portion (the wall portion) 340 in part. Accordingly, rotation and other movement of the ground plate 500 is also regulated. Thus, in the connector 10 according to the present embodiment, holding the ground plates 500 by the holding member 300 is yet further strengthened.

Although the specific explanation about the present invention is made above referring to the embodiments, the present invention is not limited thereto but susceptible of various modifications and alternative forms. For example, though the ground plate 500 is provided with the extension portions 540 extending rearward from the coupling portion 520 in the present embodiment, the ground plate 500 may not have the extension portions 540. Moreover, though each of the press-fit portions 530 of the ground plate 500 is located between the protruding portions 510 in the pitch direction in the present embodiment, the press-fit portions 530 may be located at both end portions in the pitch direction or the press-fit portion 530 may be located at one of the both end portions. In addition, though the front edges 516 of the protruding portions 510 of the ground plate 500 are located forward of front edges of the flat plate portions 532 of the press-fit portions 530 in the present embodiment, the front edges of the flat plate portions 532 may be located forward of the front edges 516 of the protruding portions 510. Furthermore, though the flat plate portion 532 of the ground plate 500 has the long shape in the pitch direction in the present embodiment, it may have a long shape in the front-rear direction. Moreover, though the flange portion 340 of the holding member 300 is formed with the through holes 342 in the present embodiment, a wall portion(s) may be used in place of the flange portion 340, and grooves opening outward in the pitch direction may be formed in the wall portion(s) in place of the through holes 342 located at the both sides in the pitch direction. Yet further, though the flange portion 340 of the holding member 300 is formed with the grooves 350 as the press-fitted portions in the present embodiment, through holes penetrating the flange portion (the wall portion) 340 in the front-rear direction may be formed in place of the grooves 350. In addition, in a case that the waterproofing function is unnecessary, the water-stop portions 116, 542 and 622, the rear insulator 700 and the gasket 800 are dispensable.

The present application is based on a Japanese patent application of JP2016-114289 filed with the Japan Patent Office on Jun. 8, 2016, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 Connector
20 Subassembly
100, 200 Contact Row
110, 210 Contact
112 Contact Point Portion
114 Press-fit Portion
116 Water-stop Portion
118 Fixed Portion
120 Connection Portion
130, 230 Contact Insulator
300 Holding Member
310 Mating Portion
312 Upper Surface
314 Lower Surface
316 Contact Accommodation Portion
320 Holding Portion
321 Upper Surface
322 Reinforcing Protrusion Portion
323 Lower Surface
324 Shallow Groove Portion
326 Contact Holding Hole
330 Base Portion
340 Flange Portion (Wall Portion)
342 Through Hole
344 Slot
346 Partition Wall (Regulating Portion)
348 Protruding Portion
350 Groove (Press-fitted Portion)
400 Mid-plate
410 Main Plate
412 Main Portion
414 Connection Portion
430 Locking Member
432 Arm Portion
434 Fixed Portion
500 Ground Plate
510 Protruding Portion
512 Rear End
514 Front End Portion
516 Front Edge
520 Coupling Portion
522 Recess Portion
530 Press-fit Portion
532 Flat Plate Portion
534 Press-fit Protrusion
536 Connection Portion
540 Extension Portion
542 Water-stop Portion
550 Leg Portion
600 Front Shell
610 Tubular Portion
612 Welded Portion
620 Leg Portion
622 Water-stop Portion
630 Connector Accommodation Portion
650 Rear Shell
652 Press-fit Portion
700 Rear Insulator
710 Press-fitted Portion
712 Press-fit Protrusion
720 Groove
800 Gasket

The invention claimed is:

1. A connector which is mateable with a mating connector along a front-rear direction, wherein:

the connector comprises a plurality of contacts, a holding member, a mid-plate and a ground plate;

the holding member comprises a mating portion, a holding portion and a base portion;

the mating portion has a tongue-like shape and extends forward from the holding portion in the front-rear direction;

the holding portion is located between the mating portion and the base portion in the front-rear direction;

the base portion is provided with at least one regulating portion and at least one press-fitted portion;

the contacts are held by the holding portion of the holding member to form two contact rows;

the contacts included in each of the contact rows are arranged in a pitch direction perpendicular to the front-rear direction;

the contact rows are arranged apart from each other in an up-down direction perpendicular to both of the front-rear direction and the pitch direction;

the mid-plate is held by the holding member and located between the contact rows in the up-down direction;

the ground plate has a plurality of protruding portions, a coupling portion and a press-fit portion;

the coupling portion couples rear ends of the protruding portions to each other;

the press-fit portion has a flat plate portion intersecting with the up-down direction and press-fit protrusions protruding from the flat plate portion in the pitch direction;

the press-fit portion is held by the press-fitted portion, so that the ground plate is attached to the holding member; and the regulating portion is located between the protruding portions in the pitch direction and located forward of the coupling portion in the front-rear direction.

2. The connector as recited in claim 1, wherein:

the base portion has a wall portion which protrudes outward in the up-down direction and extends in the pitch direction;

the wall portion is provided with through holes which penetrate the wall portion in the front-rear direction;

the through holes are arranged apart from each other in the pitch direction;

in the through holes, the protruding portions are accommodated, respectively, in part; and the regulating portion is located between the through holes in the pitch direction.

3. The connector as recited in claim 2, wherein:

the press-fitted portion is formed in the wall portion;

the press-fit portion further has a connection portion which connects the coupling portion and the flat plate portion; and the connection portion is located rearward of the wall portion in the front-rear direction.

4. The connector as recited in claim 3, wherein the press-fitted portion is a groove recessed inward in the up-down direction.

5. The connector as recited in claim 3, wherein a position of the press-fitted portion in the pitch direction is identical to a position of the regulating portion in the pitch direction.

6. The connector as recited in claim 4, wherein:

the connector further comprises a shell;

the flat plate portion of the press-fit portion is flush with an end face of the wall portion in the up-down direction or protrudes outward of the end face of the wall portion in the up-down direction; and the flat plate portion is welded to the shell.

7. The connector as recited in claim 1, wherein a size of thickness of at least a part of the protruding portion is smaller than a size of thickness of the coupling portion.

8. The connector as recited in claim 1, wherein:

the regulating portions are two in number; and the protruding portions are three in number.

9. The connector as recited in claim 8, wherein:

the holding portion is formed with reinforcing protrusion portions and shallow groove portions;

the reinforcing protrusion portions protrude outward of the shallow groove portions in the up-down direction and extend forward from the regulating portions, respectively, in the front-rear direction;

the shallow groove portions are located between the reinforcing protrusion portions and outward of the reinforcing protrusion portions in the pitch direction, respectively; and the protruding portions are located in the shallow groove portions, respectively, in part.

10. The connector as recited in claim 9, wherein:

a front end portion of each of the protruding portions is tapered so as to narrow forward; and a middle position of a front edge of each of two of the protruding portions located outward in the pitch direction among the protruding portions is nearer to a middle of the connector in the pitch direction than a middle position of the shallow groove portion in which the protruding portion is located.

11. The connector as recited in claim 9, wherein each of two of the protruding portions located outward in the pitch direction among the protruding portions extends forward in the front-rear direction and toward a middle of the connector in the pitch direction.

12. The connector as recited in claim 1, wherein:

the ground plate has a water-stop portion;

the water-stop portion is formed with a plurality of grooves intersecting with the front-rear direction; and the connector further comprises a rear insulator which covers the water-stop portion.

* * * * *